US007861326B2

(12) United States Patent
Harty

(10) Patent No.: US 7,861,326 B2
(45) Date of Patent: Jan. 4, 2011

(54) MODULAR NECK PROTECTION DEVICE

(76) Inventor: Robert D. Harty, 500 Hartland, New Lenox, IL (US) 60451

( * ) Notice: Subject to any disclaimer, the term of this patent is extended or adjusted under 35 U.S.C. 154(b) by 346 days.

(21) Appl. No.: 10/687,162

(22) Filed: Oct. 16, 2003

(65) Prior Publication Data

US 2004/0078877 A1 Apr. 29, 2004

(51) Int. Cl.
*A41D 13/00* (2006.01)

(52) U.S. Cl. ..... 2/468

(58) Field of Classification Search ..... 2/171, 2/456, 171.2, 69, 207, 208.7, 209.13, 209.14, 2/202–205, 209.4, DIG. 11, 195.1, 468; 601/79; 602/74–75; 482/10, 11, 93; 607/109, 110, 607/139, 112

See application file for complete search history.

(56) References Cited

U.S. PATENT DOCUMENTS 3,657,739 A * 4/1972 Holmes, Sr. ..... 2/468
3,713,657 A * 1/1973 Presta ..... 473/208
3,921,626 A * 11/1975 Neel ..... 602/18
4,745,922 A * 5/1988 Taylor ..... 607/104
4,891,501 A * 1/1990 Lipton ..... 607/110
5,005,374 A * 4/1991 Spitler ..... 62/259.3
5,215,080 A * 6/1993 Thomas et al. ..... 607/112
5,458,628 A * 10/1995 Cipolla ..... 607/112
5,483,698 A * 1/1996 Douglas, Jr. ..... 2/462
5,546,607 A * 8/1996 Roberts ..... 2/406
5,557,807 A * 9/1996 Hujar et al. ..... 2/171.2
5,723,002 A * 3/1998 Delk et al. ..... 607/114
6,009,566 A * 1/2000 Hubbard ..... 2/468
6,017,606 A * 1/2000 Sage et al. ..... 428/68
6,058,517 A * 5/2000 Hartunian ..... 2/468
6,854,134 B2 * 2/2005 Cleveland ..... 2/422

* cited by examiner

*Primary Examiner*—Tejash Patel
(74) *Attorney, Agent, or Firm*—Cherskov & Flaynik

(57) ABSTRACT

A device is provided to protect the neck and the base of the skull of a person engaged in sports or other physical activities. The device comprises a first impact-resistant pliable substrate for protecting the back of the person's head, a second cushioning substrate lining the first substrate. The device encircles a substantial portion of the person's neck; with straps or other fastener devices provided to facilitate closure and anchoring of the device around the person's neck. While the device is typically worn with a helmet and attached thereto, the device also may be used alone, or in combination with a soft-style cap.

13 Claims, 3 Drawing Sheets

MODULAR NECK PROTECTION DEVICE

BACKGROUND OF THE INVENTION

1. Field of the Invention

The present invention relates to the field of neck protection and, more particularly, the invention relates to devices that protect a person's neck while he or she engages in a variety of activities.

2. Description of the Prior art

The human brain and spine are very vulnerable to injuries to the back of the head and particularly to the base of the skull. This is a most critical area for it is there that the spinal cord emerges from the brain. Injury to the spinal cord threatens every aspect of human physiology: control of respiration, heart rate, body temperature, consciousness, swallowing, vaso-constriction and dilation, and a myriad other autonomic nervous system functions. Injury to the brain stem or spinal cord may result in paralysis and even death.

The neck and the base of the human head are frequently injured in a variety of sports and other physical activities. Present practice is to provide the sports participant with a helmet designed to protect the top of a person' skull. However, helmets provide little protection to a person's neck (i.e., cervical spine) or base of the skull Notable examples are helmets intended for hockey, bicycling, football, baseball car-racing, canoeing, etc.

There are several neck supports available. Many of these fail to provide protection to the critical area where the spinal cord meets the base of the skull. (See e.g. U.S. Pat. No. 3,921,626 to Neel and U.S. Pat. No. 4,576,150 to Auracher). Others are intended to immobilize the head by the use of a rigid structure (U.S. Pat. No. 3,713,657 to Presta).

None of the above devices are intended to be potentially integrated with a head-protection system that includes a helmet.

U.S. Pat. Nos. 4,638,510 and 6,009,566 issued to Hubbard on Jan. 27, 1987 and Jan. 4, 2000 respectively, disclose a neck protection device for use with a race car. Known as the HANS device (acronym for Head And Neck Support), this instrument restricts forward motion of the skull in sudden, forward impact scenarios. As such, the device includes a restraining yoke which extends down the ventral torso of a seated driver.

A need exists in the art for a device to protect the neck and thus the brain stem and the upper spinal cord from injury. Such a device would be modular in that it may be worn alone or in conjunction with a sports helmet to which the device may be attached. The device would enable a wearer to walk, run, tumble, while maintaining complete mobility. Such a device also would not impede access to the trachea, ears, face and other areas so as to facilitate observation and treatment of these areas if an injury should occur.

SUMMARY OF THE INVENTION

It is an object of the present invention to provide a device for protecting the neck and the base of the skull of a person engaged in sports or in other physical activities that overcomes many of the disadvantages of the prior art.

It is a further object of the present invention to provide a device for protecting the neck and the base of the skull of a person engaged in sports or in other physical activities that may be utilized with different sized persons. It is a feature of the present invention that it includes an adjustable strap. An advantage of the present invention is that it ensures that a team equipped with enough standard specimens of the present invention will be able to accommodate all its members.

Another object of the present invention is to provide a device for protecting the neck of a person engaged in sports or in other physical activities that allows treatment of the person's trachea while the person is wearing the device. A feature of the present invention is a shield to protect the cervical area of a patient and a similar but detachable shield to protect the front of the neck of the patient. An advantage of the present invention is that it allows for an emergency tracheotomy while the person is still wearing the device.

Yet another object of the present invention is to provide a device for protecting the neck and the base of the skull of a person engaged in sports or in other physical activities that does not impede blood flow while the person is wearing the device. A feature of the present invention is that it includes person contact points at a multitude of locations thus distributing the force exerted by the device. An advantage of the present invention is that it eliminates the danger of excessive contact pressure occurring at one or more body points while the device is worn.

A further object of the present invention is to provide a device for protecting the neck of a person engaged in sports or in other physical activities that allows unimpeded motion of the person's head, either side-to-side, or front-to-back, while the person is using the device. It is a feature of the present invention that it includes non-rigid materials to facilitate motion of the head. An advantage of the present invention is that it allows unimpeded vision and motion while also conferring maximum protection to those moving anatomical structures.

Still another object of the present invention is to provide a device for protecting the neck and the base of the skull of a person engaged in sports or in other physical activities who is also wearing a helmet. It is a feature of the present invention that it includes means to attach the invented device to a helmet. Alternatively, the invention can be integrally molded or permanently attached to the helmet. An advantage of the present invention is that it facilitates simultaneous protection of the entire skull and neck by extending head protection conferred by the helmet to those areas.

Yet another object of the present invention is to provide a device for protecting the neck and the base of the skull of a person engaged in sports or in other physical activities who is wearing a helmet or some type of head protection. It is a feature of the present invention that it may extend under any helmet of head covering. An advantage of the present invention is that it allows use of the same device for protecting the neck and the base of the skull of a person engaged in a variety of sports or in other physical activities which require wearing different helmets, and without the necessity of modifying those helmets or the neck protector.

Briefly, the invention provides a modular device to protect the neck and the base of the skull of a person engaged in sports or in other physical activities. The device may be used by a person who is also wearing a helmet. The device comprises an outer impact-resisting pliable first substrate for protecting the back and the sides of the person's neck; a second cushioning substrate in communication with the first substrate, whereby the second substrate is adapted to encircle the person's neck; and a strap equipped with fastening means to provide closure of the device around the person's neck.

The invention also provides a device for imparting physical protection and predetermined temperature application to the human neck, the device comprising a first substrate extending along the vertebra column of the region; a second substrate integrally molded to the first substrate and extending along lateral portions of the neck; and a means for positioning cold packs or hot packs within the device so as to effect the temperature of the neck.

BRIEF DESCRIPTION OF THE DRAWING

The foregoing invention and its advantages may be readily appreciated from the following detailed description of the invention, when read in conjunction with the accompanying drawing in which.

DETAILED DESCRIPTION OF THE INVENTION

The present invention provides a modular device to protect the neck and the base of the skull of a person engaged in sports or in other physical activities who also may be wearing a helmet. The device can be worn separately, with regular headwear (i.e, with its upwardly extending end 26 tucked underneath a baseball cap), or in conjunction with a helmet. The device could be worn so that a downwardly depending end is left unfastened.

Figure 1:
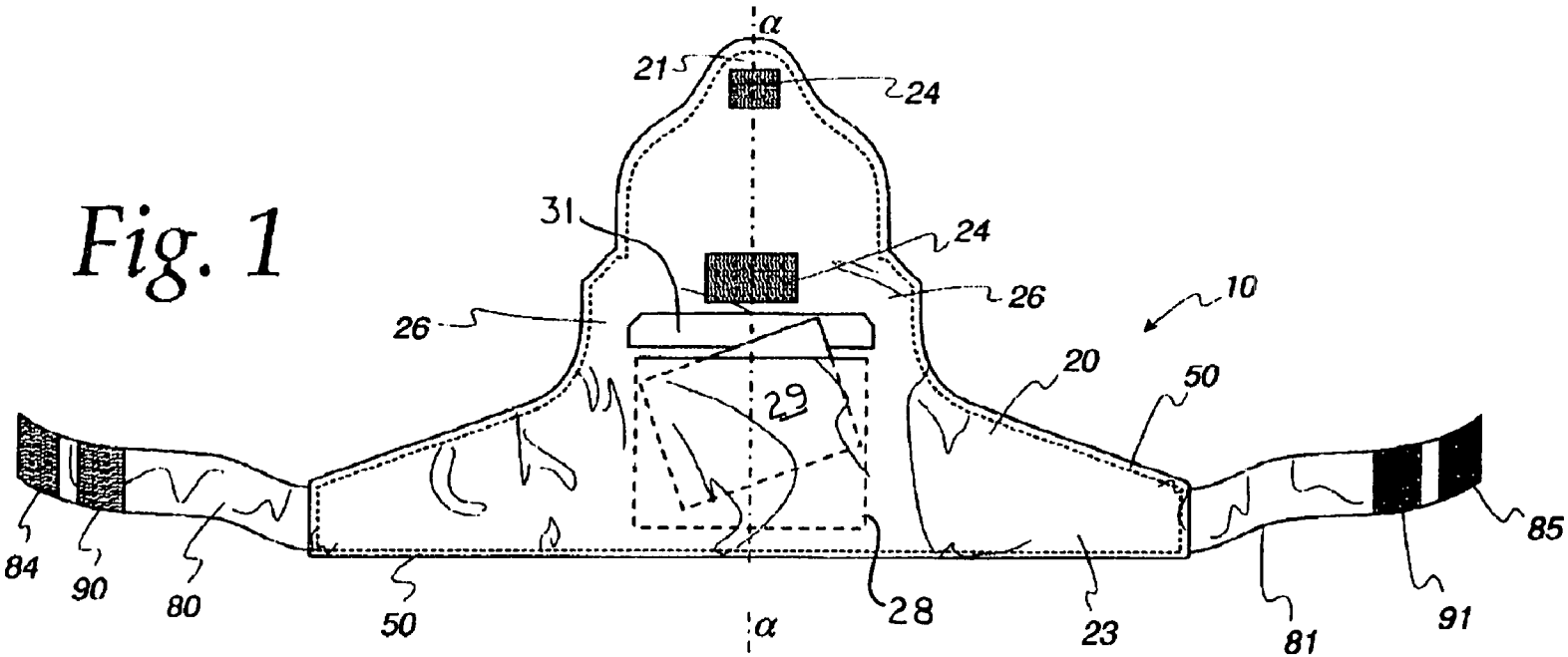
FIG. 1 is a plan view of an outwardly facing (i.e. dorsal) surface of a neck protection device in an unfastened configuration, in accordance with features of the present invention.

As shown in FIG. 1, the neck protection device, generally designated as 10, is comprised of three components: an outer impact-resistant pliable substrate 20, a cushioned (i.e., reversibly deformable) lining 50, and closure straps 80, 81. Generally, the outer substrate is rigid, but it also can be a dense pliable material. Exemplary materials for use as an outer substrate includes, but is not limited to, plastics, leather, wood, metal, fiberglass, carbon composite, aramid fiber substrates including but not limited to poly para-phenyleneterephthalamide (i.e., Kevlar®), and combinations of these materials.

While the device is illustrated with the three components integrally molded with each other, the components can be removably attached (i.e., via a hook-and-pile configuration) and juxtaposed to each other. Also, the cushioned lining may omitted if an outer pliable substrate is used and is sufficiently soft. Another alternative is to provide cushioning only along the edges of the substrate 20.

The device 20 has a first upwardly extending end 21 and a downwardly depending end 23. While the upwardly extending end 21 is adapted to attach to a helmet, the downwardly depending end can either remain free hanging, so as to extend down the back of the user (reminiscent of a racoon tail cap) or else attached to the user via a plurality of neck straps 80, 81 as discussed herein.

Referring to FIG. 1, a first embodiment of the device extends between the wearer's shoulders at from approximately the first thoracic vertebra to approximately the base of the wearer's cranium. Typically an upwardly extending region 21 of the device 22 would extend under the depending edge of a helmet if the person using the device wears one. A hook-and-pile configuration, snap fit configuration, peel-and-stick substrate or other reversible attachment means 24 is adapted to be received by complementary surfaces or adaptable surfaces affixed to a helmet. The fact that the support provided by the device extends to the base of the cranium and under a helmet (the helmet depicted in phantom outline in FIG. 6B) affords continuity (i.e., unbroken) neurological protection from the top of the head (conferred by a typical high impact helmet) down to the middle of the shoulder blades.

Lateral to the longitudinal axis (designated as $\alpha$) of the support, the surface 20 curves inwardly to form a pair of opposing concave surfaces 23. The concave surfaces 23 are adapted to envelop at least part of the lateral portions of the neck, particularly around and below the jaws. The device 20 may be chosen to extend ventrally when worn so that a forward-facing edge of the device terminates just behind the ears.

To maximize head mobility, these concave-forming surfaces 23 preferably are comprised of a less rigid material than the region 26 of the device directly opposing or immediately adjacent the cervical and thoracic vertebra regions of the wearer.

Figure 5:
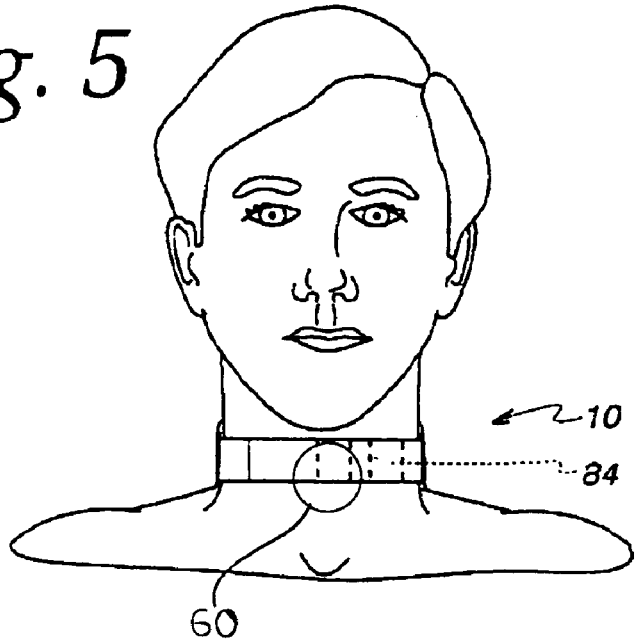
FIG. 5 is a front view of a person wearing a first embodiment of a neck protection device in a fastened configuration, in accordance with features of the present invention.
Figure 6A:
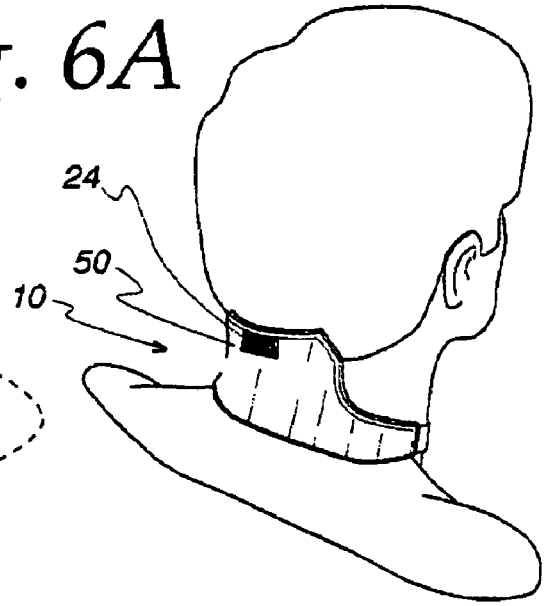
FIG. 6A is a rear view of a person wearing a first embodiment of a neck protection device in a fastened configuration, in accordance with features of the present invention.

FIGS. 5 and 6A show front and rear views of a person wearing the device without a helmet.

Figure 2:
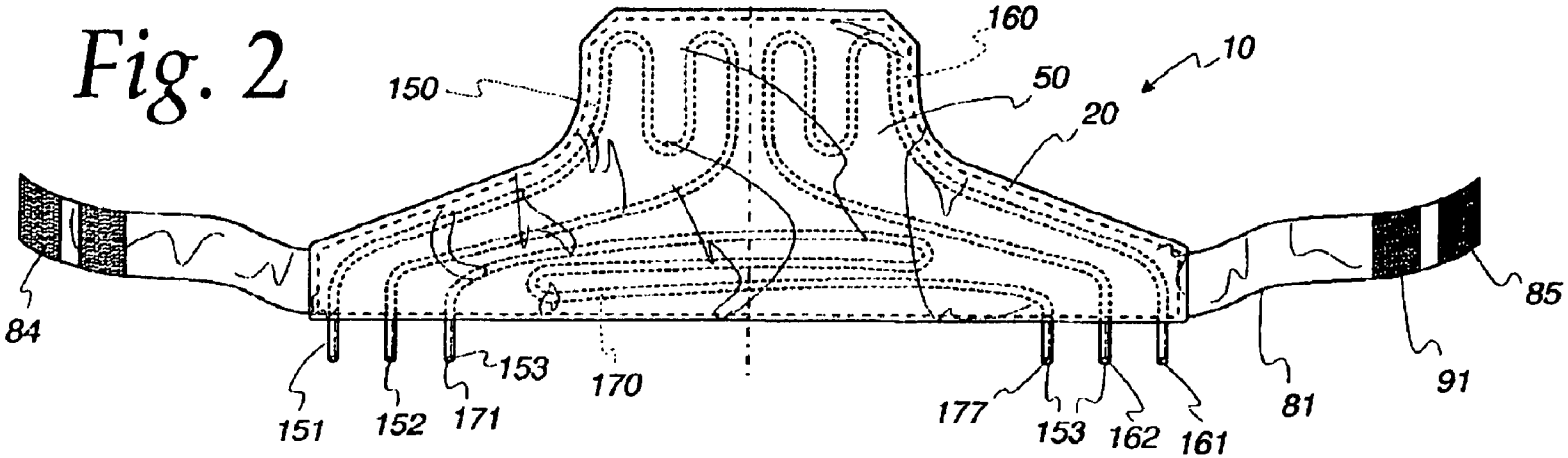
FIG. 2 is a plan view of a wearer contact surface of a neck protection device, also shown in an unfastened position, in accordance with features of the present invention.

FIG. 2 is a planar view of the inside surface (i.e. the surface contacting the person) of the present invention in an open configuration. The external surface 20 of the protective device is lined with an inner cushioning lining 50 such as rubber foam, gel, or an inflatable cushion.

The inflatable cushion can include an inflatable bladder or series of bladders or conduits adapted to receive fluid of various temperatures and phases. For example, the lining 50 may comprise a plurality of reversibly deformable substrates, such as plastic conduits or sacs, which may receive any suitable fluid such as air (for cushioning), a heated fluid, a cooled fluid, or a combination of such fluid phases and temperatures.

The embodiment depicted in FIG. 2 comprises a plurality of tubes 150, 160, and 170, for the right, left, and bottom sides respectively of the lining 50. These tubes each have an inlet 151, 161, and 171, respectively, and an outlet 152, 162, 172, the outlets facilitating the filling of the tubes. The three-tubes configuration allows the application of different fluids to different areas of the neck if necessary. If only fluid is used, one may join two or three tubes in series or in parallel. Other tubing arrangements can be used as well. Each of the conduits is provided with a means 153 for regulating fluid flow through the conduits. These means include standard valves such as those available through Halkey-Roberts (St. Petersburg, Fla.).

Not only will fluid-filled bladders or conduits provide cushioning means, but the fluids, if preheated or precooled, also can provide a means for warming or cooling the body surface of the wearer at that skin-contact location. The aforementioned fluid-filled bladders also are of the form which are removably inserted into a pouch 28 formed by one of the substrates comprising the device. Such bladders are typical hot packs or cold packs used by athletes, hikers, and those suffering from ailments alleviated by cold- or hot-temperature treatment. Such hot packs and cold packs are widely available commercially, such as from American Therapeutic Supply (Colorado Springs, Colo.).

The provision for a pocket or pouch to receive the temperature packs is a means to impart heat or cold to the neck, when such packs are inserted. As depicted in FIG. 1, one means for receiving a hot- or cold-pack is a pouch or pocket 28 formed by a portion of the region 26 of the device overlaying the cervical vertebra. The pouch can be formed of a transparent material so as to notify the wearer or observers of changes in pack conditions, for example in situations where the pack changes colors as it gains or loses heat. The cervical/thoracic vertebra protective region of the device also can be constructed of a material so as to accommodate team logos, reflective material, or other visual cues. Closure of the pouch (from the top as shown, or from the bottom or sides) is effected in a variety ways, including hook and pile closure configurations, zippers, snaps, or tongue-and-groove devices (i.e. Zip-Loc™ devices) 31. Such pocket-closure configurations facilitate replacement of packs while the device and/or any associated helmet is still being worn and/or while the device is connected to the helmet.

Aside from adapting an outside surface (i.e, a surface seen by an observer of the wearer) to receive a cold- or hot-pack, an inside surface 50 of the device (i.e., a surface 50 which contacts the wearer's skin) as seen in FIG. 2, also can define a receiving pocket. In this later instance, the pack can also serve as a cushioning means, said means thus situated intermediate the wearer and the rigid substrate comprising the cervical protective region of the device.

It should be noted that the lateral portions of the device which encircle the neck also can be adapted to contain fluid circulation means or the skin-temperature modifying packs, as described supra. It should be further noted that the circulating fluid or skin temperature modifying packs can be confined to certain regions of the device so as to allow other regions of the device to be maintained at ambient temperatures. This arrangement allows other regions of the device to be subjected to different fluids, or different temperatures, thereby conferring different temperature zones in different regions of the device.

The neck protection device is worn by encircling and then securing the straps 80 and 81 around the neck. The ends of the straps are reversibly joined via such reversible attachment means as hook and pile configurations, snaps or zippers.

Figure 3:
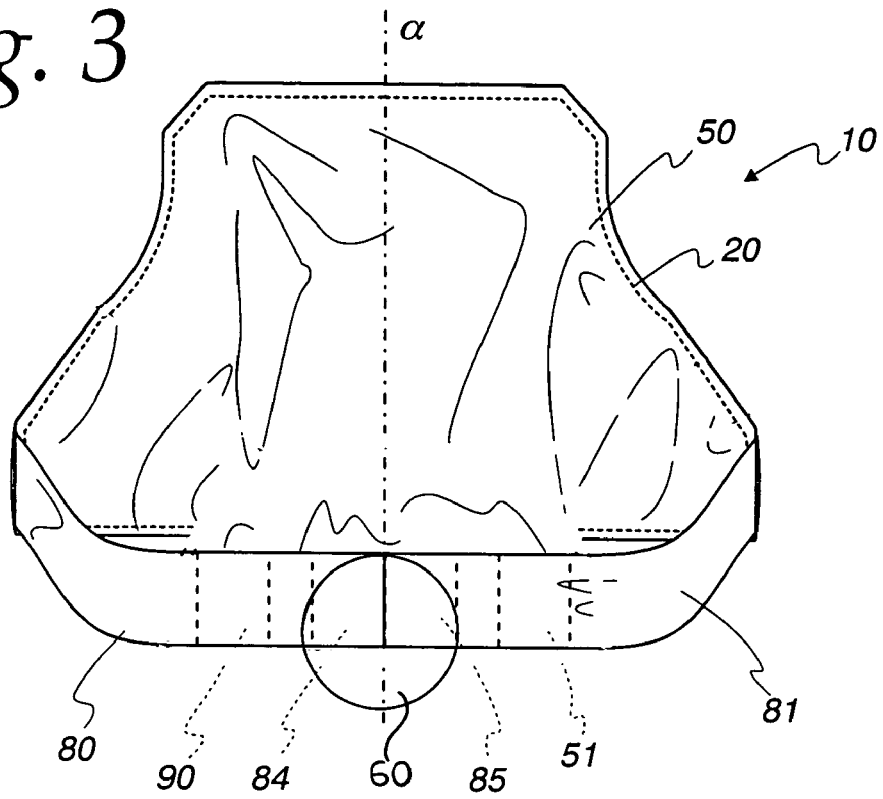
FIG. 3 is a plan view of a wear-contact surface of a the modular neck protection device in fastened configuration, in accordance with features of the present invention.

As illustrated in FIG. 3, the neck protection device optionally includes a tracheal shield 60 that may be removably attached to the straps 80, 81. In the alternative, the tracheal shield may be permanently attached to either strap 80 or 81. The shield is provided to protect the front of the neck generally, and the trachea specifically, from trauma due to blunt force or if the wearer should fall forward.

Optionally, the tracheal shield comprises a durable outer substrate (not shown) facing away from the wearer's neck, and a cushioning inner substrate (not shown) facing toward the wearer's neck. Inasmuch as the durable outer substrate is selected to protect the neck from frontal falls or blows, the substrate would be of a similar material to that which comprises the surface defining the cervical shield region (i.e., the back of the neck) 26 of the device. An outward facing surface of the shield could comprise a light, a reflector, highly visual colored surface, or some similar safety enhancement feature.

Figure 4:
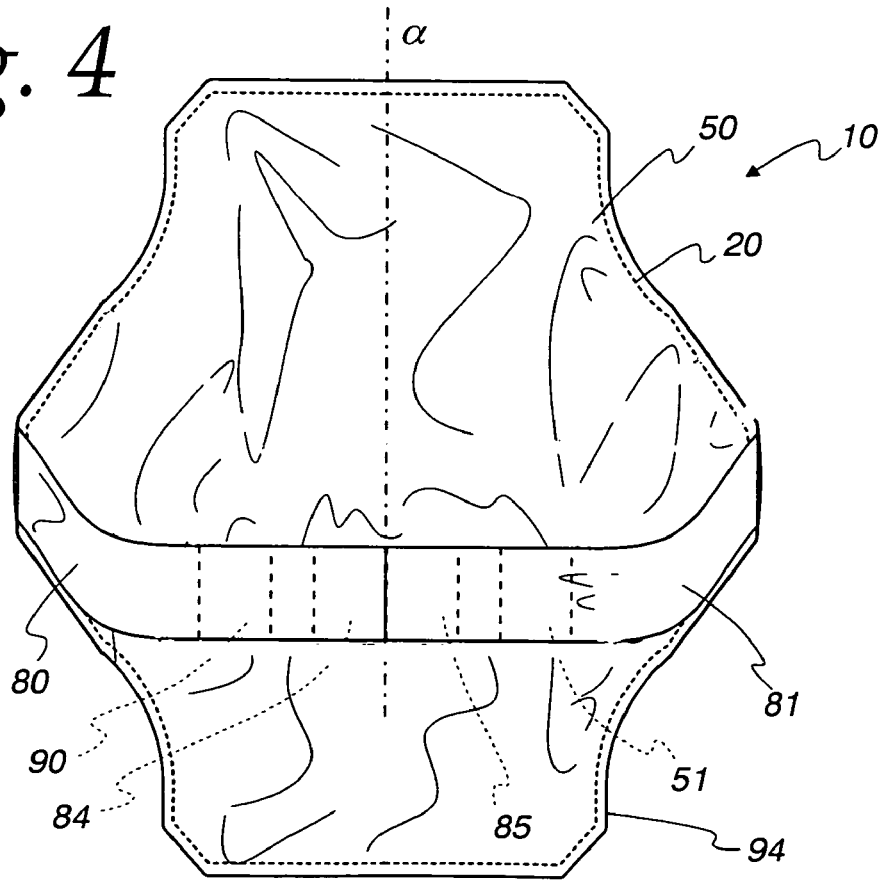
FIG. 4 is a plan view of an outwardly facing surface of another alternative embodiment of a neck protection device in a fastened configuration, in accordance with features of the present invention.

FIG. 4 shows a front view of another alternative embodiment of the device. As shown, a depending portion 94 of the cervical protective region 26 device extends down the dorsal surface (back surface) of the neck in a direction away from the base of the skull, so as to terminate in a region approximately between the wearer's shoulder blades. Preferably, the depending portion ends at approximately the middle of the shoulder blades of the wearer, i.e. below the wearer's $7^{th}$ vertebra. The device also encircles the patient's neck to confer positional stability of the device along the dorsal portion of the neck.

Figure 6B:
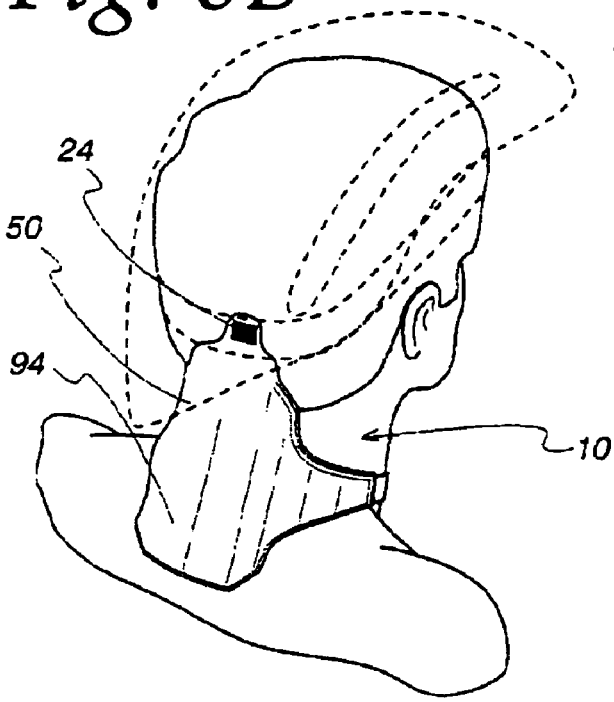
FIG. 6B is a rear view of a person wearing an alternative embodiment of a neck protection device in a fastened configuration and with a helmet, in accordance with features of the present invention.

FIGS. 5 and 6B show front and rear views of a person wearing the embodiment of this invention depicted in FIG. 4.

As noted supra, the free ends (i.e. terminal ends) of the straps 84 and 85 may be configured into complementary reversible attachment means such as hook-and-pile fastening configurations, belt and buckle arrangements, snap fit arrangements or by other similar fastening means. For additional security, additional fastening means 90, 91 situated proximal from the terminal ends can be provided.

A variety of materials may be used for the outer substrate, and similarly for the lining. Reversibly deformable material, but nevertheless shock resistant material, could be used as the outer substrate. Suitable materials include plastics including nylons, such as poly-para-phenylene terephtalamide, marketed as Kevlar® by the Du Pont Corporation. Both transparent and non-transparent materials may be used. However distinct advantages accrue when both the outer substrate and the inner lining consist of transparent materials. This allows visual inspection of the neck if the person suffers an injury. Transparent substrates also allow for the quick detection of hemorrhaging or other injury. Also, it is preferable that the entire device be radio-translucent and x-ray transparent.

Generally, it is assumed that both the outer substrate and the cushioning materials consist of plastics but a multitude of materials satisfy the above requirements. Foam- and gel-like materials are especially appropriate for the cushioning substrate.

Any flexible substrate is a suitable strap constituent. As such, exemplary materials include, but are not limited to, plastic, cloth, nylon, rubber, and leather. The person's comfort is enhanced if the straps consist of, or are lined with, a soft material. Exemplary soft materials include, but are not limited to cloth, rubber, sponge, plastics, other manmade products, leather, and combinations thereof. Again, the use of radio-translucent materials may be preferable in many applications.

The strap adjustment feature allows users to adapt just one device to a myriad of users so as to accommodate children or adults having a wide range of neck sizes.

The dimensions of the device may be chosen to accommodate different sports or activities and the device may be used with or without a helmet.

In operation, the user dons the device so that it rests in the position shown in FIGS. 5, 6*a* and 6*b*. It should be noted that while the wearer in FIGS. 5, and 6*a* is not wearing a helmet, the position of the device is the same when a helmet is worn, but for the interaction of attachment means 24 with the headgear.

With or without the combination of a helmet, the device hangs benignly along the dorsal region of the cervical region of the wearer and is not "used" or otherwise utilized as a neck protection device. It is only until the wearer experiences a fall backward or is otherwise struck from behind. For example, cyclist accidents often turn fatal when the rider strikes the back of her neck against a curb or other uneven protrusion. The device is attached to the helmet to minimize its separation from the helmet in case of a fall by the wearer. As such, the device is attached to the inside surface of the helmet so that it resides intermediate the wearer and the helmet. Alternatively, the device is attached to an outside surface of the helmet at a surface of the helmet in close spatial relationship to the depending edge of the helmet which typically opposes the cervical area of the wearer.

While the device can be modular in design so as to be worn with or without headgear, the device also can be permanently attached or molded with the headgear. This would minimize the possibility of separation of the device from the helmet, and also provide a more cosmetically pleasing extension of helmet material to the device.

As noted supra, however, while the device hangs benignly as a neck protection device, the device can serve as a means for imparting heat or cold temperatures to the wearer as soon as the device is donned by the wearer. This is especially valuable for athletes and others concerned with heat build-up in warm climes or muscle/joint stiffness in cold climes.

The foregoing description is for purposes of illustration only and is not intended to limit the scope of protection accorded this invention. The present invention may be presented in other specific embodiments without departing from the essential attributes of the present invention. It is apparent that many modifications, substitutions, and additions may be made to the invention while remaining within the scope of the appended claims, which should be interpreted as broadly as possible.

The invention claimed is:

1. A device to protect the neck and the base of the skull of a person while allowing unimpeded motion of the person's head, either side to side or front-to-back, the device comprising:

a) a free-hanging first impact-resistant and physical shock resistant pliable substrate whereby said substrate encircles an extended portion of the back of the person's neck and wherein said substrate hangs downwardly from under any head covering of the person to approximately the person's first thoracic vertebra where it ends in a free-hanging, unfastened depending end, forming a zone of unbroken neurological protection along the back of the neck;

b) a reversibly deformable second substrate is juxtaposed in proximity to said first substrate and wherein said second substrate is adapted to contact the wearer at multiple and distinct locations thereby distributing force of any impact to the first substrate between the multiple and distinct contact locations; the second substrate including a means for regulating fluid flow through the second substrate; and c) straps extending from said first substrate and comprising means allowing closure of the straps around a ventral region of the neck wherein the closure of the straps results in the juxtaposition of a region planar substrate overlying the person's trachea, wherein the planar substrate is attached to one of said straps.

2. The device as recited in claim 1 further comprising a means for reversibly attaching to a helmet or a cap thereby forming a zone of unbroken neurological protection from the tip of the head of the wearer to middle of shoulder blades.

3. The device as recited in claim 1 wherein the device is integrally molded to a helmet thereby forming a zone of unbroken neurological protection from the tip of the head of the wearer to middle of shoulder blades.

4. The device as recited in claim 1 wherein the second substrate comprises a plurality of reversibly deformable substrates.

5. The device as recited in claim 1 wherein all the first substrate, the second substrate, and the straps are radio-translucent.

6. The device as recited in claim 1 wherein the first substrate is defined by an arcuate outer shell overlaying a cushioning substrate.

7. The device as recited in claim 1 wherein the second substrate further comprises reversibly deformable material which is integrally molded with said first substrate.

8. The device as recited in claim 1 wherein the first substrate and the second substrate are integrally molded to each other.

9. The device as recited in claim 1 wherein at least a portion of said first and second substrates extend along at least a portion of a dorsal surface of the person's neck.

10. The device as recited in claim 1 wherein the impact-resistant pliable substrate is shaped as a removable shield used in combination with, and reversibly attached to a protective headwear to confer uninterrupted protection from top of a wearer's head to below the wearer's seventh vertebrae.

11. The device as recited in claim 1 wherein the straps include a detachable tracheal shield to facilitate access to the ventral region of the wearer's neck.

12. The device as recited in claim 1 wherein the second substrate comprises reversibly deformable substrates only on the edges of the outer substrate.

13. The device as recited in claim 11 wherein the straps include a detachable tracheal shield to facilitate access to the neck ventral region.

* * * * *